US012060872B2

(12) United States Patent
Westling et al.

(10) Patent No.: US 12,060,872 B2
(45) Date of Patent: Aug. 13, 2024

(54) AIR COMPRESSOR

(71) Applicant: MILWAUKEE ELECTRIC TOOL CORPORATION, Brookfield, WI (US)

(72) Inventors: Bennett W. Westling, Milwaukee, WI (US); Dalton F. Hansen, Whitefish Bay, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/530,780

(22) Filed: Nov. 19, 2021

(65) Prior Publication Data

US 2022/0074398 A1 Mar. 10, 2022

Related U.S. Application Data

(63) Continuation of application No. 16/539,093, filed on Aug. 13, 2019, now Pat. No. 11,204,022.
(Continued)

(51) Int. Cl.
*F04B 35/04* (2006.01)
*F04B 35/06* (2006.01)
(Continued)

(52) U.S. Cl.
CPC ..... *F04B 35/04* (2013.01); *F04B 35/06* (2013.01); *F04B 39/121* (2013.01); *F04B 41/02* (2013.01); *F04B 39/0044* (2013.01)

(58) Field of Classification Search
CPC .... F04B 35/04; F04B 39/0044; F04B 39/121; F04B 41/02; F04B 35/06
See application file for complete search history.

(56) References Cited

U.S. PATENT DOCUMENTS 635,517 A 10/1899 Simmons
1,566,963 A 12/1925 Hargrove
(Continued)

FOREIGN PATENT DOCUMENTS

CA 2574341 A1 7/2007
CN 201874776 U 6/2011
(Continued)

OTHER PUBLICATIONS

Ridgid, "Operator's Manual, 6 Gal. Air Compressor, OF60150HA," 2016, 44 pages.
(Continued)

*Primary Examiner* — Christopher S Bobish
(74) *Attorney, Agent, or Firm* — Michael Best & Friedrich LLP

(57) ABSTRACT

A portable air compressor includes a frame, a compressor unit coupled to the frame, and an air tank for storing compressed air generated by the compressor unit. The air tank is coupled to the frame. A battery compartment coupled to the frame. The battery compartment defines an opening and a battery receptacle within the opening. The portable air compressor also includes a battery pack selectively electrically connectable to the battery receptacle, an outlet port protruding from the battery compartment, a tank gauge on the battery compartment, a pressure regulator between the air tank and the outlet port for regulating the pressure of air supplied from the outlet port, an actuator on the battery compartment for adjusting the regulated pressure of air supplied from the outlet port, and a switch on the battery compartment for turning the compressor unit on and off.

2 Claims, 10 Drawing Sheets

Related U.S. Application Data

(60) Provisional application No. 62/718,446, filed on Aug. 14, 2018.

(51) Int. Cl.
*F04B 39/00* (2006.01)
*F04B 39/12* (2006.01)
*F04B 41/02* (2006.01)

(56) References Cited

U.S. PATENT DOCUMENTS 1,694,218 A 12/1928 Hazard
1,962,836 A 6/1934 Peterson
2,267,479 A 12/1941 Sturm et al.
2,605,044 A 7/1952 Hill
3,462,074 A 8/1969 Grimmer
3,776,666 A 12/1973 Ludwig
3,885,892 A 5/1975 Dwyer et al.
4,059,123 A * 11/1977 Bartos ..... B08B 3/026 134/102.2
4,060,340 A 11/1977 Yanik et al.
4,129,404 A 12/1978 Korner et al.
4,190,402 A 2/1980 Meece et al.
4,389,166 A 6/1983 Harvey et al.
4,558,994 A 12/1985 Viola et al.
4,621,984 A * 11/1986 Fussell ..... F04B 35/06 417/234
4,729,722 A 3/1988 Toth
4,801,250 A 1/1989 Lammers
4,915,594 A 4/1990 Lammers
4,968,221 A 11/1990 Noll
5,030,067 A 7/1991 Ushiota et al.
5,116,206 A * 5/1992 Adahan ..... F04B 17/06 92/240
5,118,262 A 6/1992 Kuo
5,127,808 A * 7/1992 Nichols ..... B62J 11/02 417/234
5,388,967 A 2/1995 Firnhaber et al.
5,411,375 A 5/1995 Bauer
5,423,395 A 6/1995 Kieffer
5,456,582 A 10/1995 Firnhaber et al.
5,556,271 A 9/1996 Zuercher et al.
5,591,281 A 1/1997 Loewe
5,681,151 A 10/1997 Wood
5,694,682 A 12/1997 Zuercher et al.
RE36,274 E 8/1999 Zuercher et al.
RE36,281 E 8/1999 Zuercher et al.
6,027,315 A 2/2000 Hogan
6,056,516 A 5/2000 Schönfeld et al.
6,095,762 A 8/2000 Wheeler
6,213,000 B1 4/2001 Wood
6,227,815 B1 5/2001 Chandra et al.
D444,796 S 7/2001 Morgan
6,254,358 B1 7/2001 Merz
6,336,797 B1 1/2002 Kazakis et al.
6,349,630 B1 2/2002 Wood
6,357,338 B2 3/2002 Montgomery
6,375,437 B1 4/2002 Nolan
6,386,833 B1 5/2002 Montgomery
D460,763 S 7/2002 Buck
D461,196 S 8/2002 Buck
6,431,839 B2 8/2002 Gruber et al.
6,435,076 B2 8/2002 Montgomery
6,447,257 B2 9/2002 Orschell
6,468,048 B1 10/2002 Burkholder et al.
6,532,990 B1 3/2003 Wood et al.
6,532,991 B1 3/2003 Wood et al.
6,551,066 B2 4/2003 Saylor et al.
6,582,201 B2 6/2003 Lucchi
D482,371 S 11/2003 Buck
6,655,925 B1 12/2003 Robenalt et al.
6,742,995 B1 6/2004 Wood et al.
D493,179 S 7/2004 Buck
D498,244 S 11/2004 Chen
6,811,384 B2 11/2004 Virgilio
D499,747 S 12/2004 Buck
6,923,364 B2 8/2005 Burkholder et al.
6,923,627 B1 8/2005 Wood et al.
6,942,464 B2 9/2005 Brashears et al.
6,991,437 B2 1/2006 Cherry et al.
6,994,528 B2 2/2006 Brashears et al.
6,994,529 B2 2/2006 Downes
6,995,529 B2 2/2006 Sibley
7,025,573 B1 4/2006 Hardin et al.
7,086,841 B2 8/2006 Cornwell
7,098,424 B2 * 8/2006 Silvestro ..... B23K 9/1006 219/133
D529,518 S 10/2006 Buck
7,131,824 B2 11/2006 Baron
7,153,106 B2 12/2006 Cornwell
7,163,382 B1 1/2007 Stilwell et al.
D541,306 S 4/2007 Welsh et al.
7,272,977 B2 9/2007 Coleman
7,316,541 B2 1/2008 Baron
7,325,476 B2 2/2008 Sanderson
7,384,245 B2 6/2008 Hernandez et al.
7,413,414 B2 8/2008 Wood et al.
7,438,029 B2 10/2008 Fox et al.
7,458,784 B2 12/2008 Vos et al.
D589,985 S 4/2009 Steinfels
7,556,478 B2 7/2009 Klein et al.
7,563,077 B2 7/2009 Santa Ana
D604,746 S 11/2009 Nishido et al.
7,648,343 B2 1/2010 Cornwell
7,721,641 B2 5/2010 Lund
7,762,790 B2 7/2010 Steinfels et al.
7,782,626 B2 8/2010 Buck et al.
7,811,067 B2 10/2010 Dietzsch et al.
7,832,991 B2 11/2010 Wood et al.
7,874,807 B2 1/2011 Hill et al.
7,887,303 B2 2/2011 Sadkowski et al.
7,909,584 B2 3/2011 Etter et al.
8,057,196 B2 11/2011 Wood
8,079,824 B2 * 12/2011 Chou ..... F04B 35/06 417/16
D664,996 S 8/2012 Hsiao
8,267,666 B2 9/2012 Gruber et al.
8,282,363 B2 * 10/2012 Ohi ..... F04B 41/02 417/423.15
8,303,261 B1 11/2012 Hawkins
8,303,262 B1 11/2012 Hawkins
8,313,309 B1 11/2012 Hawkins
8,393,873 B2 3/2013 Hill et al.
D680,555 S 4/2013 Craig et al.
D680,556 S 4/2013 Craig et al.
8,579,600 B2 11/2013 Vijayakumar
8,616,159 B1 12/2013 Hawkins
8,727,741 B2 5/2014 Nutz et al.
8,740,013 B2 6/2014 Elberson
8,770,341 B2 7/2014 Wood et al.
D710,902 S 8/2014 Vintzel
D710,903 S 8/2014 Vintzel et al.
8,814,535 B2 8/2014 Etter et al.
8,851,229 B2 10/2014 Vos et al.
8,864,476 B2 10/2014 Moormann et al.
8,894,389 B2 11/2014 Meza et al.
8,899,378 B2 12/2014 Wood et al.
8,920,133 B2 12/2014 Bosua
8,935,995 B1 1/2015 Hawkins
8,961,145 B2 2/2015 Hill et al.
8,967,324 B2 3/2015 White et al.
9,046,096 B2 6/2015 Diekmeyer et al.
9,097,246 B2 8/2015 Vos et al.
9,127,662 B2 9/2015 Vos et al.
9,181,938 B2 11/2015 Vos et al.
9,309,876 B2 4/2016 Wood et al.
9,353,679 B2 5/2016 Hruschka
9,458,845 B2 10/2016 White et al.
9,670,920 B2 6/2017 Vos et al.
9,816,507 B2 11/2017 Vijayakumar
D806,755 S 1/2018 Wood
9,903,358 B2 2/2018 Hernandez et al.
10,012,223 B2 7/2018 White et al.

(56) References Cited

U.S. PATENT DOCUMENTS

| | | | | |
|---|---|---|---|---|
| 10,036,375 | B2 | 7/2018 | White et al. | |
| 10,514,029 | B2 * | 12/2019 | Suarez | F04B 39/10 |
| D902,261 | S | 11/2020 | Vintzel et al. | |
| D917,579 | S | 4/2021 | Nishido et al. | |
| 2003/0235505 | A1 | 12/2003 | Brunelli | |
| 2004/0096341 | A1 | 5/2004 | Hung | |
| 2005/0196290 | A1 | 9/2005 | Hu | |
| 2005/0214136 | A1 | 9/2005 | Tsai | |
| 2006/0065309 | A1 | 3/2006 | Leasure et al. | |
| 2006/0104830 | A1 | 5/2006 | Fields | |
| 2006/0104836 | A1 * | 5/2006 | Phillips | F04B 41/02 417/410.1 |
| 2006/0108970 | A1 * | 5/2006 | Leasure | F04B 41/02 429/454 |
| 2006/0153697 | A1 | 7/2006 | Johnson et al. | |
| 2006/0245937 | A1 | 11/2006 | Goodwin et al. | |
| 2007/0065302 | A1 | 3/2007 | Schmitz | |
| 2007/0148013 | A1 * | 6/2007 | Hong | F16F 15/067 417/360 |
| 2007/0212236 | A1 | 9/2007 | Turan | |
| 2008/0003111 | A1 | 1/2008 | Turan | |
| 2008/0181794 | A1 | 7/2008 | Steinfels et al. | |
| 2009/0010770 | A1 | 1/2009 | Hernandez et al. | |
| 2009/0110567 | A1 | 4/2009 | Averill et al. | |
| 2010/0021331 | A1 | 1/2010 | Hruschka | |
| 2010/0329898 | A1 | 12/2010 | Dunn et al. | |
| 2011/0182754 | A1 | 7/2011 | Gathers et al. | |
| 2011/0194904 | A1 | 8/2011 | Carlson | |
| 2011/0214423 | A1 * | 9/2011 | Givens | F02B 63/04 290/1 A |
| 2011/0290354 | A1 | 12/2011 | Wood et al. | |
| 2013/0064689 | A1 | 3/2013 | White et al. | |
| 2013/0065503 | A1 * | 3/2013 | White | F04D 29/668 454/254 |
| 2014/0037425 | A1 | 2/2014 | White et al. | |
| 2014/0069826 | A1 | 3/2014 | Vijayakumar | |
| 2015/0152857 | A1 | 6/2015 | White et al. | |
| 2016/0138578 | A1 | 5/2016 | White et al. | |
| 2016/0178084 | A1 | 6/2016 | White et al. | |
| 2018/0073495 | A1 | 3/2018 | White et al. | |
| 2018/0320677 | A1 * | 11/2018 | Thackery | F04B 41/02 |
| 2019/0219044 | A1 * | 7/2019 | Arnold | F04B 35/06 |
| 2020/0056602 | A1 | 2/2020 | Westling et al. | |

FOREIGN PATENT DOCUMENTS

| | | | | |
|---|---|---|---|---|
| CN | 201874802 | U | 6/2011 | |
| CN | 101699069 | B | 5/2012 | |
| CN | 101865117 | B | 5/2012 | |
| CN | 202338472 | U | 7/2012 | |
| CN | 204099160 | U | 1/2015 | |
| CN | 204152747 | U | 2/2015 | |
| CN | 105443370 | A | 3/2016 | |
| CN | 205207075 | U | 5/2016 | |
| CN | 105840454 | A | 8/2016 | |
| CN | 102312819 | B | 3/2017 | |
| CN | 206175163 | U | 5/2017 | |
| CN | 206257019 | U | 6/2017 | |
| CN | 107143486 | A | 9/2017 | |
| CN | 105065232 | B | 11/2017 | |
| CN | 206988050 | U | 2/2018 | |
| CN | 207131546 | U | 3/2018 | |
| CN | 107939648 | A | 4/2018 | |
| CN | 207315599 | U | 5/2018 | |
| CN | 207315610 | U | 5/2018 | |
| CN | 207333138 | U | 5/2018 | |
| CN | 207349046 | U | 5/2018 | |
| EP | 0940580 | A2 | 9/1999 | |
| EP | 1039131 | B1 | 1/2004 | |
| EP | 1688619 | A2 | 8/2006 | |
| EP | 1688619 | A2 * | 8/2006 | F04B 35/06 |
| EP | 1947335 | A2 | 7/2008 | |
| EP | 2006541 | A2 | 12/2008 | |
| EP | 2392823 | A2 | 12/2011 | |
| EP | 2570664 | A2 | 3/2013 | |
| EP | 2570665 | A2 | 3/2013 | |
| EP | 2570666 | A2 | 3/2013 | |
| EP | 2570667 | A2 | 3/2013 | |
| EP | 2570668 | A2 | 3/2013 | |
| EP | 2570669 | A2 | 3/2013 | |
| EP | 2570670 | A2 | 3/2013 | |
| EP | 2347164 | B1 | 11/2013 | |
| EP | 2706233 | A1 | 3/2014 | |
| EP | 2706234 | A1 | 3/2014 | |
| JP | 2002285967 | A | 10/2002 | |
| WO | 1994022064 | A2 | 9/1994 | |
| WO | 2001029421 | A1 | 4/2001 | |
| WO | 2001092723 | A1 | 12/2001 | |
| WO | 2006089303 | A2 | 8/2006 | |
| WO | 2009014069 | A1 | 1/2009 | |
| WO | 2017041378 | A1 | 3/2017 | |
| WO | 2017107409 | A1 | 6/2017 | |

OTHER PUBLICATIONS

Ryobi, "Airbase Compressor Kit, Model #YN301PL," <https://www.ryobitools.com/outdoor/products/details/airbase-compressor-kit> webpage publicly available at least as early as Sep. 1, 2016.

The Home Depot, "RIDGID, 18-Volt Cordless Brushless 1 Gal. Portable Air Compressor, R0230," <https://www.homedepot.com/p/RIDGID-18-Volt-Cordless-Brushless-1-Gal-Portable-Air-Compressor-Tool-Only-R0230/300507507> publicly avaiable as early as Nov. 22, 2018.

The Home Depot, "RYOBI, 6 Gal. Vertical Pancake UMC Compressor, Model # YG601PV1," <https://www.homedepot.com/p/RYOBI-6-Gal-Vertical-Pancake-UMC-Compressor-YG601PV1/205611067> publicly available as early as Oct. 12, 2014.

ToolGuyd, "RIDGID, 18V Cordless 1 Gallon Air Compressor, R0230," <https://toolguyd.com/ridgid-cordless-air-compressor/> publicly available as early as Feb. 9, 2017.

* cited by examiner

AIR COMPRESSOR

CROSS-REFERENCE TO RELATED APPLICATIONS

This application is a continuation of co-pending U.S. patent application Ser. No. 16/539,093 filed on Aug. 13, 2019, now U.S. Pat. No. 11,204,022, which claims priority to U.S. Provisional Patent Application No. 62/718,446 filed on Aug. 14, 2018, the entire contents of both of which are incorporated herein by reference.

FIELD OF THE INVENTION

The present invention relates to air compressors, and more particularly to portable air compressors.

BACKGROUND OF THE INVENTION

Air compressors include an outlet port for attaching a hose to receive compressed air to run a pneumatic tool. Air compressors also include a tank gauge for indicating pressure of compressed air stored within a storage tank and a dial for regulating pressure supplied from the outlet port. Air compressors also include one or more switches for turning the compressor on and off.

SUMMARY OF THE INVENTION

The present invention provides, in one aspect, a portable air compressor comprising a frame, a compressor unit, and a plurality of elastomeric mounts coupling the compressor unit to the frame, such that during operation of the compressor unit, vibration from the compressor unit to the frame is inhibited. The portable air compressor further comprises an air tank for storing compressed air generated by the compressor unit. The air tank is coupled to the frame. The portable air compressor further comprises a battery compartment coupled to the frame. The battery compartment defines an opening and a battery receptacle within the opening. The portable air compressor unit further comprises a battery pack selectively electrically connectable to the battery receptacle to provide power to the compressor unit, an outlet port for supplying compressed air from the air tank, a tank gauge for indicating a pressure of the air stored within the air tank, a pressure regulator between the air tank and the outlet port for regulating the pressure of air supplied from the outlet port, an actuator for adjusting the regulated pressure of air supplied from the outlet port, and a flexible compressed air line fluidly coupling the compressor unit to the air tank. The flexible compressed air line is arranged between the compressor unit and the battery compartment. The portable air compressor further comprises a switch for turning the compressor unit on and off.

The present invention provides, in another aspect, a portable, battery-powered air compressor comprising a housing, a compressor unit within the housing, and an air tank for storing compressed air generated by the compressor unit. The housing and the air tank collectively define a first side and a second side that is opposite the first side. The compressor further comprises an outlet port on the first side for supplying compressed air from the air tank, a tank gauge on the first side for indicating a pressure of the air stored within the air tank, a pressure regulator between the air tank and the outlet port for regulating the pressure of air supplied from the outlet port, and an actuator on the first side for adjusting the regulated pressure of air supplied from the outlet port. The compressor further comprises a battery receptacle coupled to the housing. The housing at least partially defines an opening on the first side to access the battery receptacle. The battery receptacle is configured to receive a battery pack to provide power to the compressor unit. The compressor further comprises a switch on the first side for turning the compressor unit on and off.

The present invention provides, in yet another aspect, a portable, battery-powered air compressor comprising a housing, a compressor unit within the housing, an air tank for storing compressed air generated by the compressor unit, a first outlet port for supplying compressed air from the air tank, a second outlet port for supplying compressed air from the air tank, a pressure regulator between the air tank and the first and second outlet ports for regulating the pressure of air supplied from the first outlet port and the second outlet port, a battery receptacle coupled to the housing, and a battery pack electrically connectable to the battery receptacle to provide power to the compressor unit.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
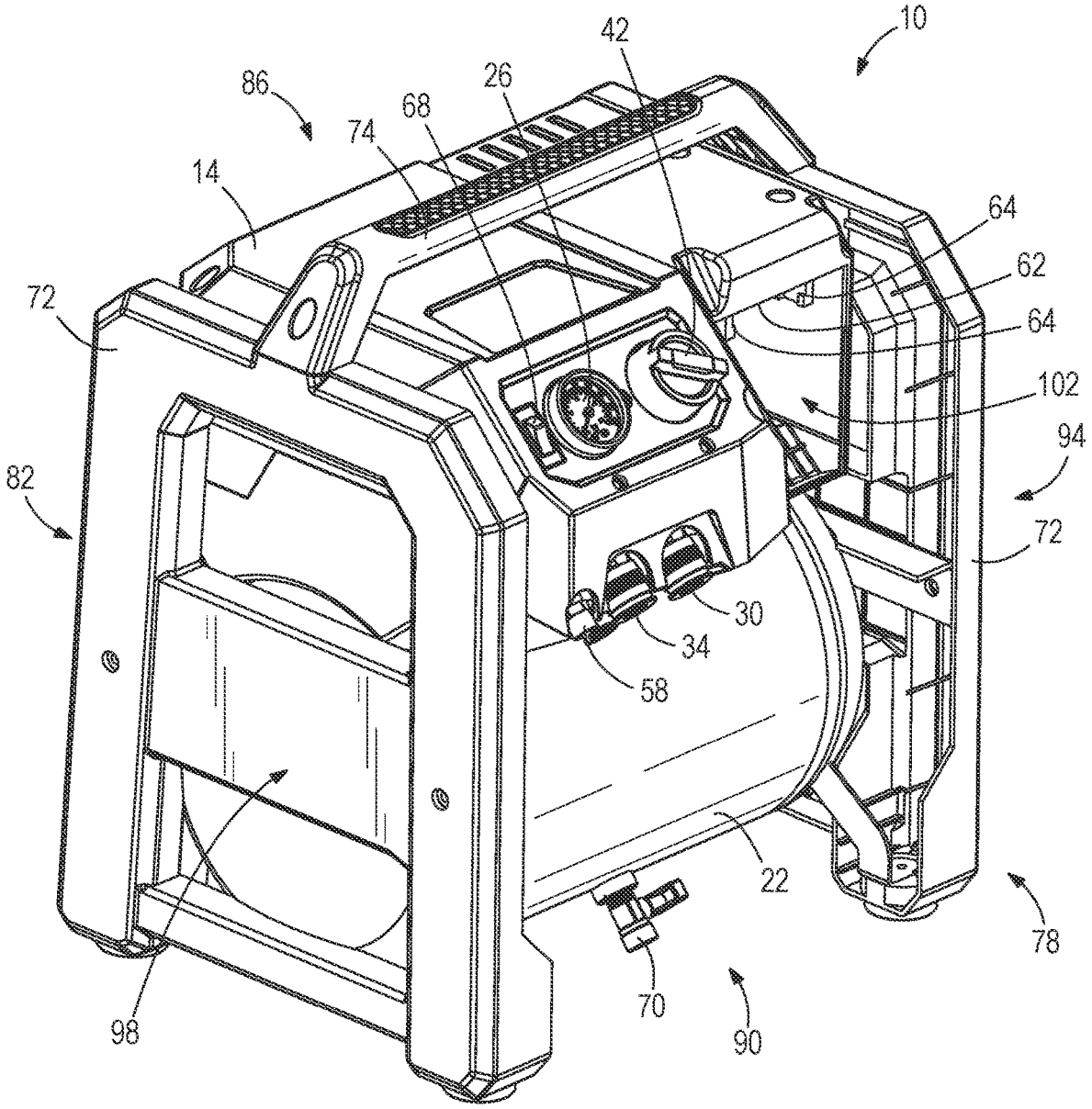
FIG. 1 is a perspective view of an air compressor in accordance with an embodiment of the invention.

A shown in FIGS. 1-9, a portable, battery-powered compressor 10 includes a housing 14, a compressor unit 18 (FIG. 9) within the housing 14 for compressing air, and an air tank 22 for storing air compressed by the compressor unit 18. The air tank 22 has a volume of 2.5 gallons, thus making the compressor 10 portable and able to be hand-carried by users to and between job sites. The compressor unit 18 includes an electric motor 24 and a reciprocating, single-cylinder pump 25 driven by the motor 24 to supply compressed air to the air tank 22. In some embodiments, the motor 24 is a brushless DC electric motor operable from an 18 Volt power source. The compressor 10 also includes a tank gauge 26 for indicating a pressure of air stored within the air tank 22 (FIG. 1). The compressor 10 further includes a first outlet port 30 and a second outlet port 34 for supplying compressed air from the air tank 22. In the illustrated embodiment, the first and second outlet ports 30, 34 are configured as quick-release female fittings to which hoses having corresponding male fittings may be attached.

Figure 9:
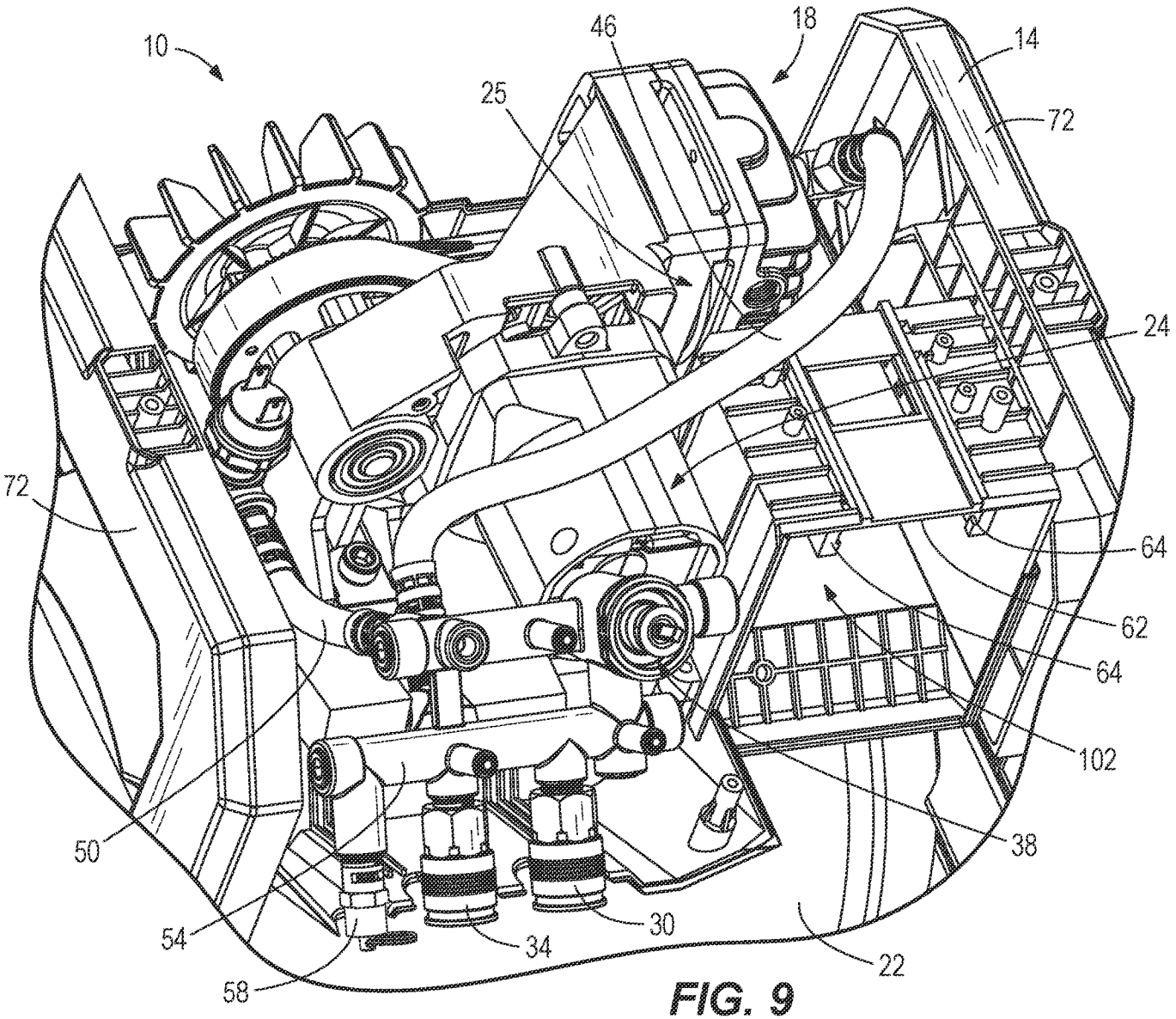
FIG. 9 is an enlarged perspective view of the air compressor of FIG. 1 with portions removed.
Figure 10:
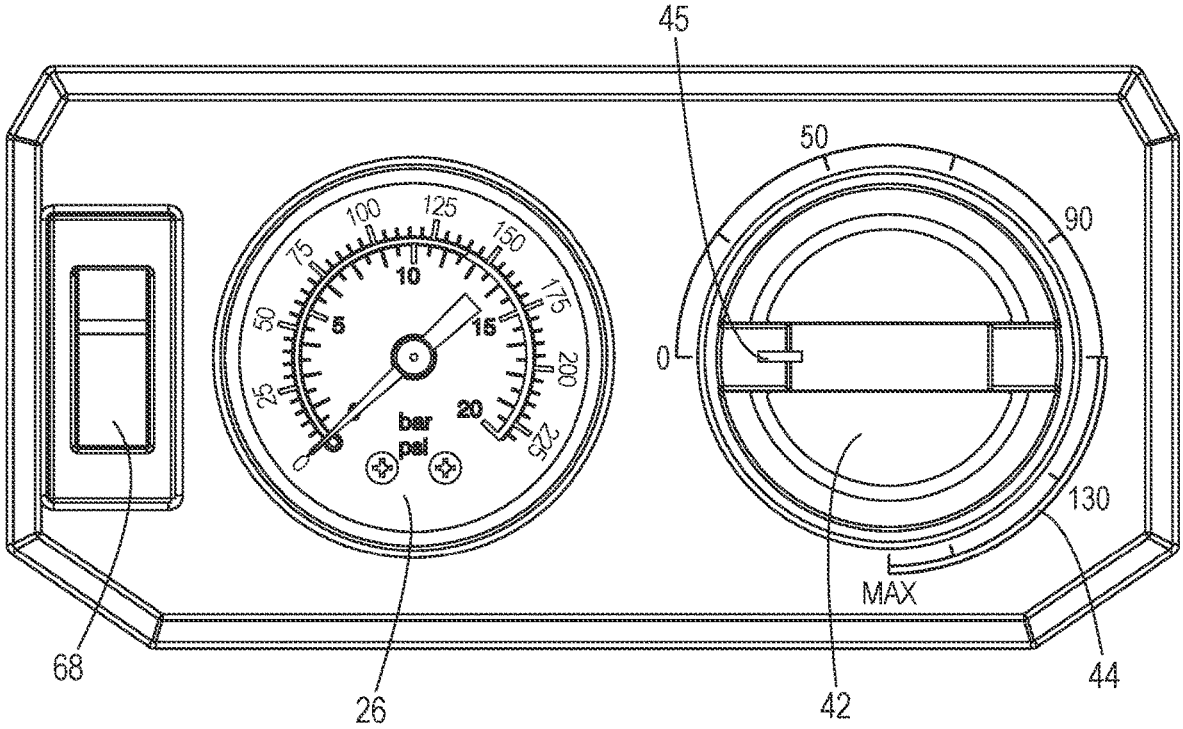
FIG. 10 is a plan view of a switch, an actuator, and a tank gauge of the air compressor of FIG. 1.

As shown in FIG. 9, the compressor 10 includes a pressure regulator 38 between the air tank 22 and the first and second outlet ports 30, 34 for regulating the pressure of air supplied from the first and second outlet ports 30, 34. The compressor 10 also includes an actuator 42 (e.g., a dial, shown in FIG. 1) for adjusting the pressure regulator 38 and thus, the regulated pressure of air supplied from the first and second outlet ports 30, 34. As shown in FIG. 10, the compressor 10 also includes a pressure scale 44 adjacent the actuator 42 to indicate the regulated pressure selected by the actuator 42, thus eliminating the need for a second tank gauge to indicate regulated pressure. In the illustrated embodiment, the actuator 42 is configured as a rotatable dial with a pointer 45 to point to a pressure level on the pressure scale 44 to indicate the regulated pressure of pressure regulator 38. The compressor 10 includes a compressed air line 46 (FIG. 9) fluidly coupling the compressor unit 18 to the air tank 22, a supply line 50 fluidly coupling the air tank 22 to the regulator 38, and an outlet manifold 54 downstream of the regulator 38 to supply compressed air at a regulated pressure to the first and second outlet ports 30, 34. The compressor 10 further includes a pressure relief valve 58. Prior to putting the compressor 10 in storage for a period of time, the operator can actuate the pressure relief valve 58 to discharge compressed air stored in the air tank 22, the supply line 50, and the outlet manifold 54.

Figure 2:
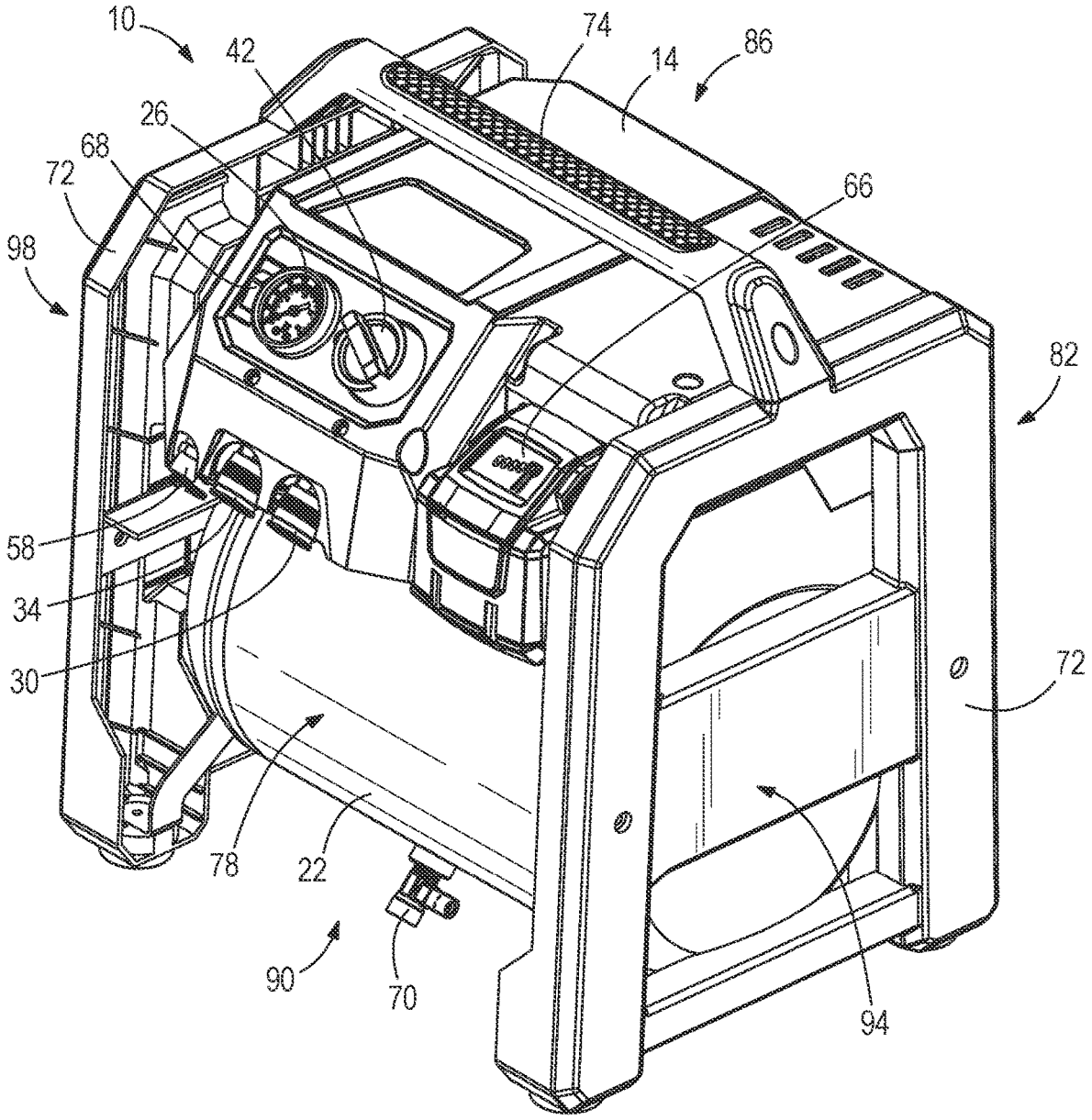
FIG. 2 is another perspective view of the air compressor of FIG. 1.
Figure 4:
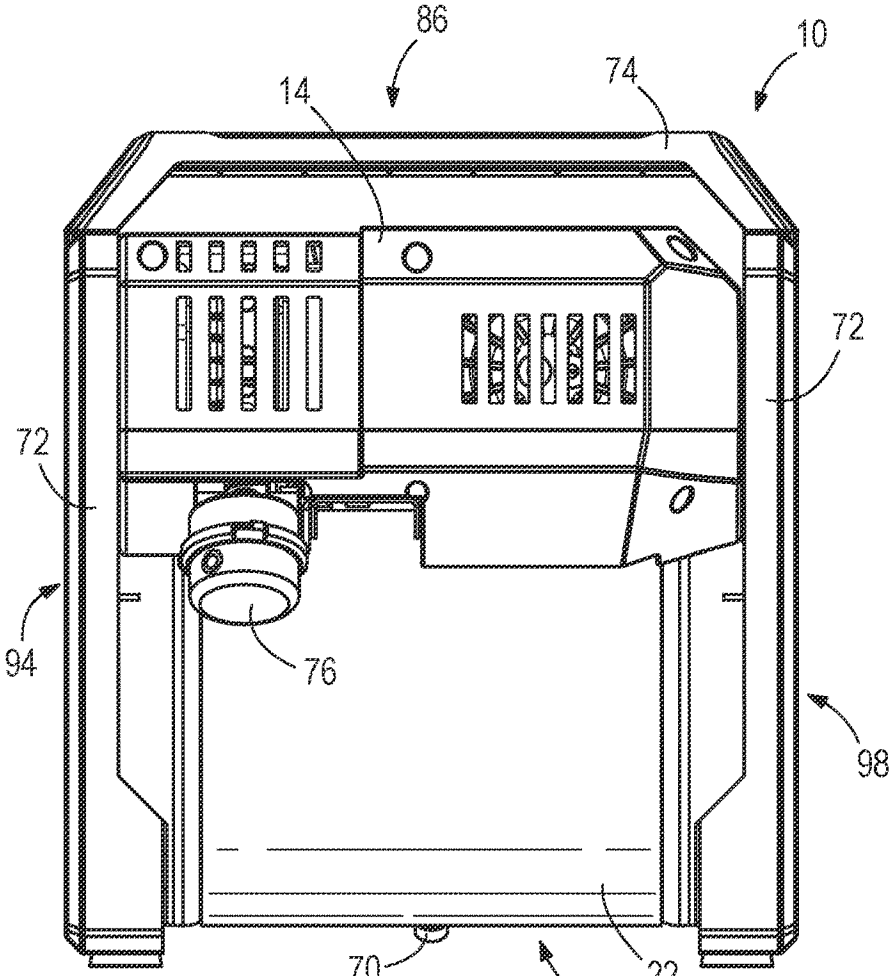
FIG. 4 is a plan view of a second side of the air compressor of FIG. 1 opposite the first side.
Figure 3:
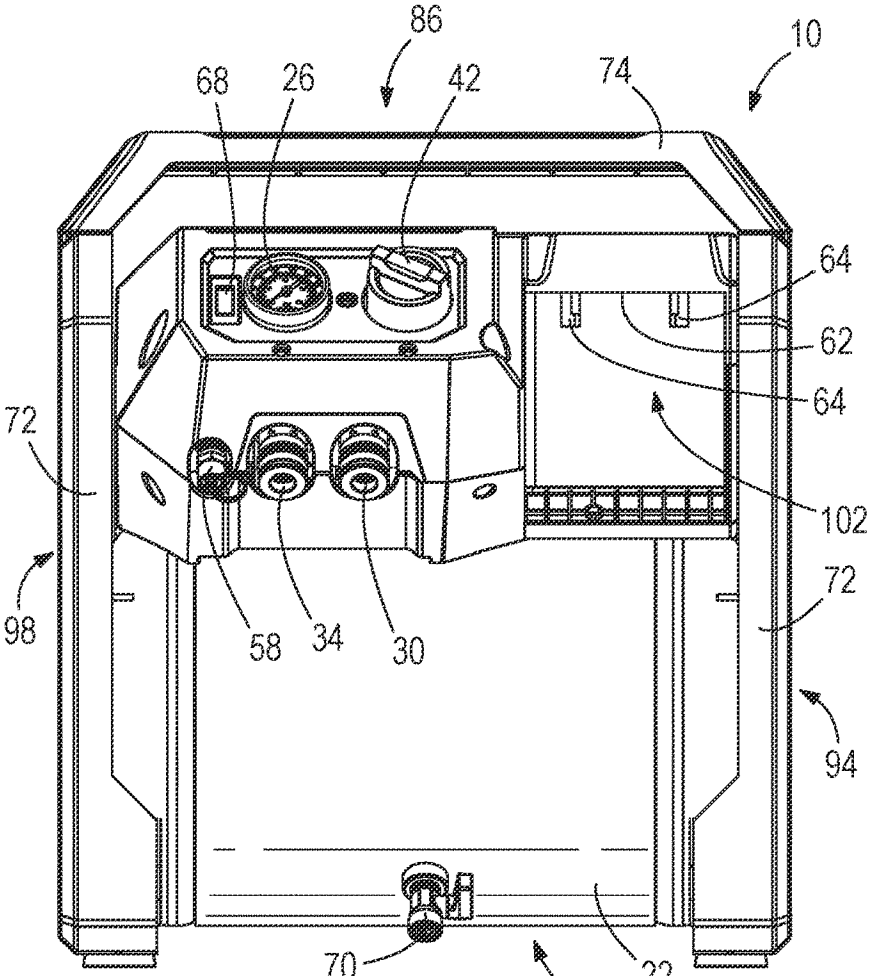
FIG. 3 is a plan view of a first side of the air compressor of FIG. 1.

As shown in FIGS. 1 and 3, the compressor 10 also includes a battery receptacle 62 coupled to the housing 14. The battery receptacle 62 includes a pair of rails 64 for engaging corresponding grooves (not shown) on a battery pack 66, thereby allowing the battery pack 66 to be mounted in battery receptacle 62 as shown in FIG. 2. The battery receptacle 62 also includes a pair of terminals (not shown) that mate with a corresponding pair of terminals (not shown) on the battery pack 66, such that the battery pack 66 can provide power to the compressor unit 18 when it is received in the battery receptacle 62. In some embodiments, the battery pack 66 is a rechargeable power tool battery pack, such as an 18V lithium-ion battery pack. The compressor 10 also includes a switch 68 for turning the compressor unit 18 on and off. The air tank 22 includes a drain valve 70 for draining condensation accumulated in the air tank 22 when the air tank 22 is depressurized with the relief valve 58. The compressor 10 includes a pair of legs 72 attached to the housing 14 and the air tank 22 for supporting the compressor 10 upon a surface and a handle 74 coupled therebetween. With reference to FIG. 4, the compressor 10 includes a filter 76 through which air is drawn into the compressor unit 18.

As shown in FIGS. 1-8, the housing 14 and the air tank 22 collectively define a first (front) side 78 (viewed but unlabeled in FIG. 3), a second (rear) side 82 (viewed but unlabeled in FIG. 4) opposite the first side 78, a top 86 (viewed but unlabeled in FIG. 5), a bottom 90 (viewed but unlabeled in FIG. 6) opposite the top 86, a third side 94 (viewed but unlabeled in FIG. 7), and a fourth side 98 (viewed but unlabeled in FIG. 8) opposite the third side 94. As shown in FIGS. 1-3, the tank gauge 26, the first and second outlet ports 30, 34, the actuator 42, and the switch 68 are all located on the first side 78. Also, the housing 14 at least partially defines an opening 102 on the first side 78 to provide access to the battery receptacle 62. As such, the battery pack 66 is attachable to and removable from the battery receptacle 62 from the first side 78. Additionally, both the pressure relief valve 58 and the drain valve 70 are on the first side 78.

Even though one or more of the tank gauge 26, the first and second outlet ports 30, 34, the actuator 42, the switch 68, the opening 102, and the pressure relief valve 58 are arranged on different surfaces of the housing 14, they are all on the first side 78 because they are all visible when viewing the compressor 10 from the viewpoint shown in FIG. 3 and accessible to a user when situated across from the first side 78 of the compressor 10. Similarly, even though drain valve 70 is on the air tank 22, the drain valve 70 is on the first side 78 because it is visible from the viewpoint shown in FIG. 3 and accessible to a user when situated across from the first side 78 of the compressor 10. In other words, no portion of any of the tank gauge 26, the first and second outlet ports 30, 34, the actuator 42, the switch 68, the opening 102, the pressure relief valve 58, and the drain valve 70 is obstructed by the housing 14 or air tank 22 when viewing the compressor 10 from the viewpoint shown in FIG. 3 (the first side 78).

Figure 5:
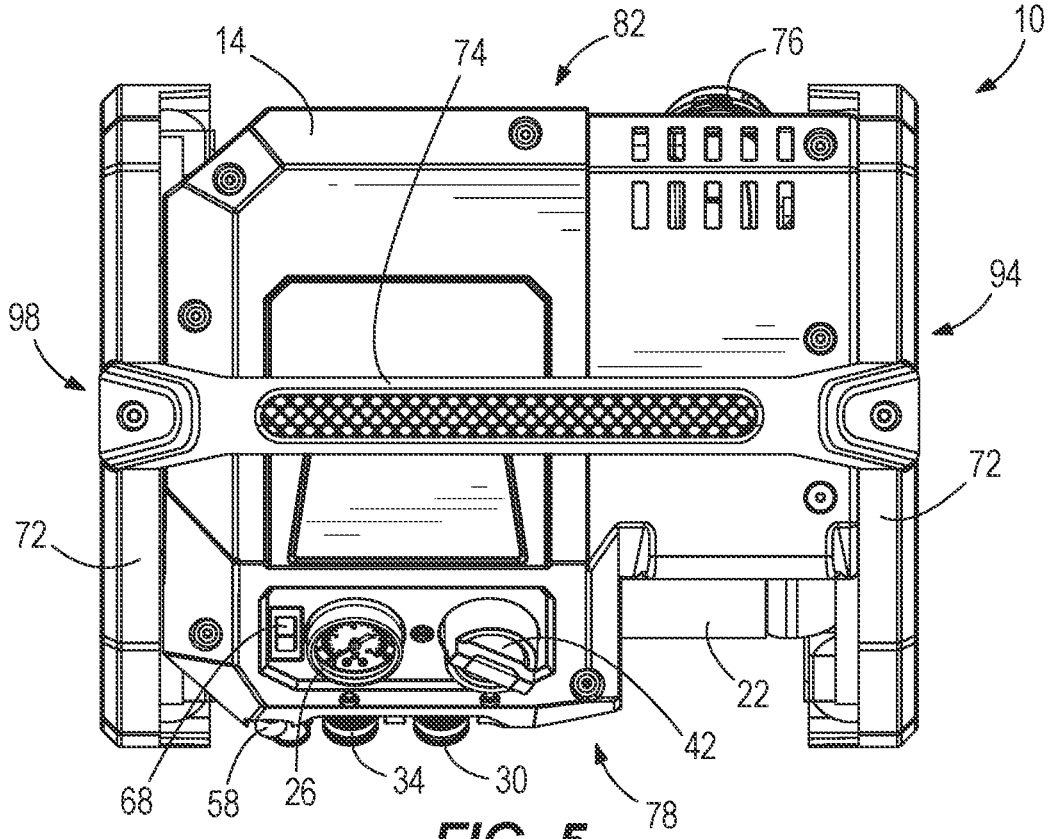
FIG. 5 is a plan view of the top of the air compressor of FIG. 1.
Figure 6:
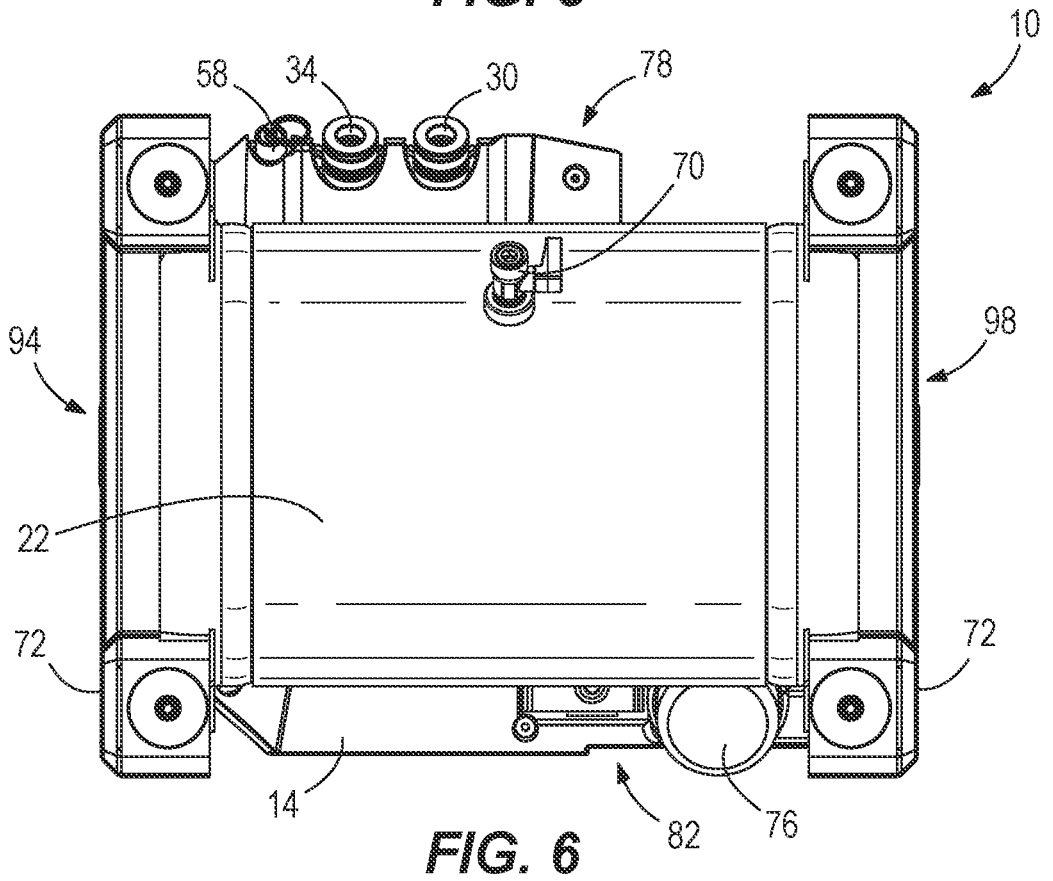
FIG. 6 is a plan view of the bottom of the air compressor of FIG. 1 opposite the top.
Figure 8:
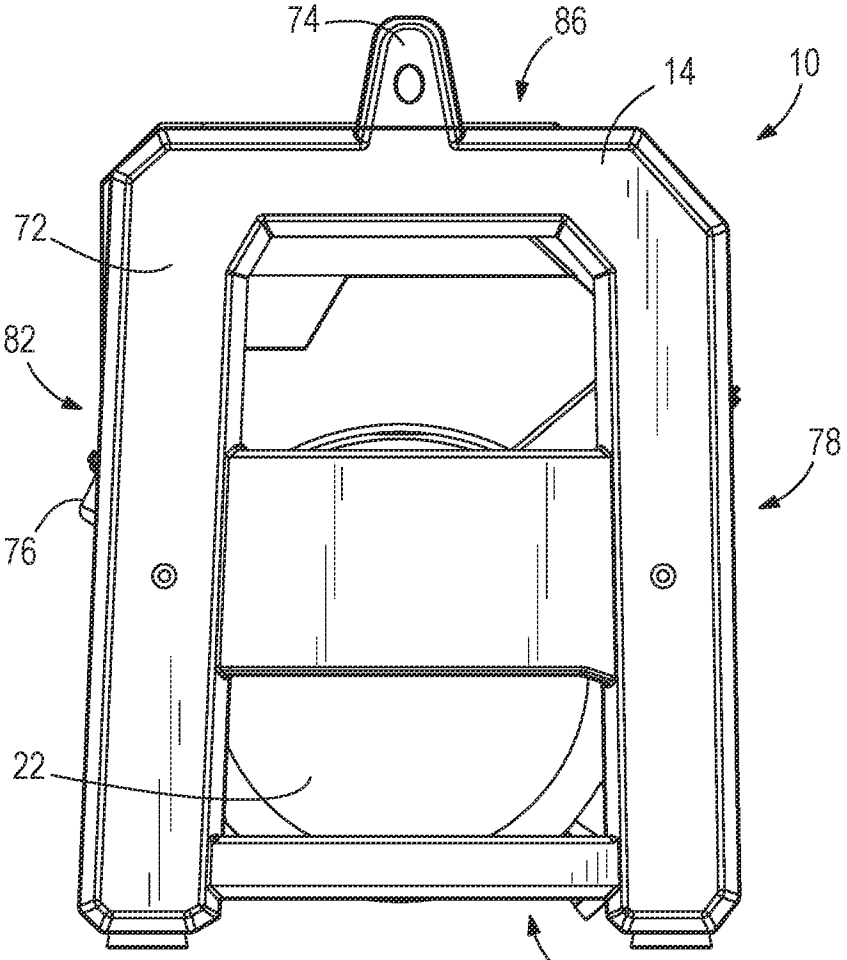
FIG. 8 is a plan view of a fourth side of the air compressor of FIG. 1 opposite the third side.
Figure 7:
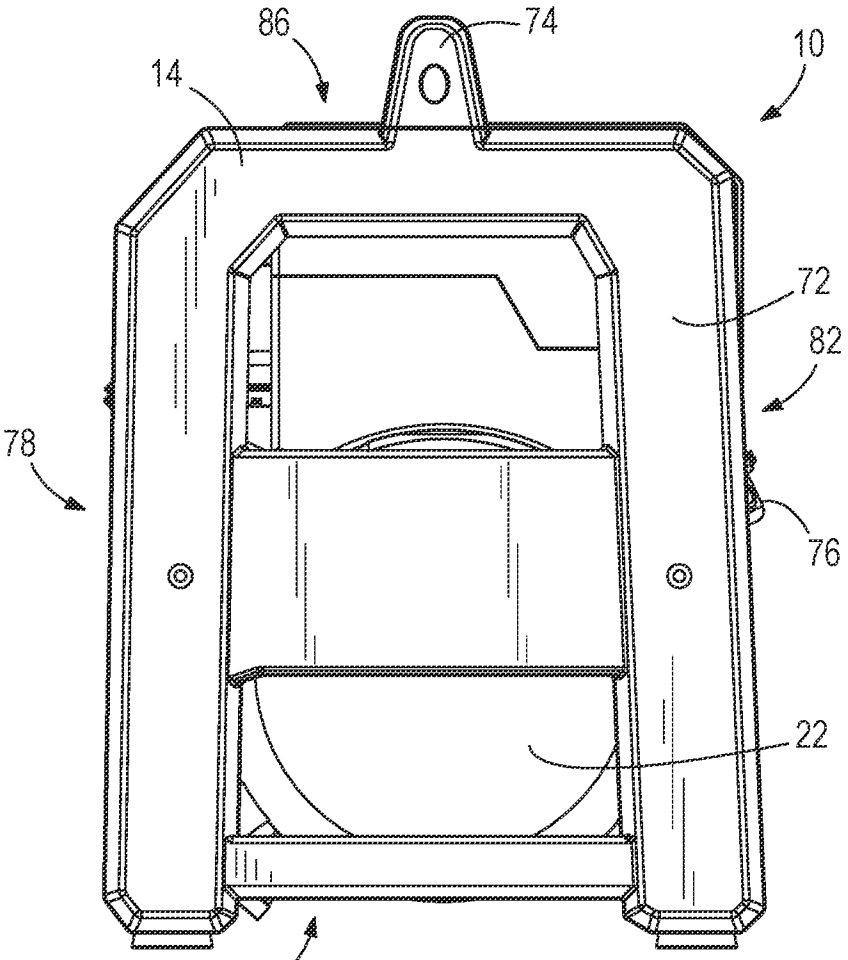
FIG. 7 is a plan view of a third side of the air compressor of FIG. 1.

Also, because no portion of any of the tank gauge 26, the actuator 42, and the switch 68 are obstructed by the housing 14 or air tank 22 when viewing and accessing the compressor 10 when situated above the top 86, as shown in the viewpoint in FIG. 5 (the top 86), the tank gauge 26, the actuator 42 and the switch 68 are on the top 86 in addition to being on the first side 78. Thus, it is easy for an operator that is standing to quickly glance down at the top 86 of the compressor 10 to evaluate and/or interact with the switch 68, the tank gauge 26 or the actuator 42. Also, because each of the elements that an operator needs to interact with in order to operate the compressor 10, including the tank gauge 26, the first and second outlet ports 30, 34, the actuator 42, the switch 68, the battery receptacle 62 and battery receptacle opening 102, the pressure relief valve 58, and the drain valve 70, are on the first side 78, operation of compressor 10 is made to be more convenient. Thus, when situated across from the first side 78 of the compressor 10, an operator does not need to reach around the top 86 or the sides 94, 98 of the compressor 10 to access the tank gauge 26, the first and second outlet ports 30, 34, the actuator 42, the switch 68, the battery receptacle 62 and battery receptacle opening 102, the pressure relief valve 58, and the drain valve 70.

Also, by having the second outlet port 34 in addition to the first outlet port 30, at least two tools or other sources requiring compressed air may be simultaneously coupled to the compressor 10, thus eliminating the need for an operator to detach a first tool before attaching a second tool to compressor 10. Additionally, the compressor 10 can supply compressed air to two tools simultaneously via the first and second outlet ports 30, 34, respectively. In some embodiments, the rated flow rate of the compressor 10 is 1.2 cubic feet per minute (CFM) at 90 psi. Thus, to avoid performance losses when operated simultaneously, the first and second tools coupled to first and second outlet ports 30, 34 should collectively require 1.2 CFM or less. For example, the first tool could require 0.6 CM and the second tool could require 0.6 CFM, or the first tool could require 0.8 CFM and the second tool could require 0.4 CFM, and both the tools could operate simultaneously without performance loss. First and second tools collectively requiring greater than 1.2 CFM can still be coupled to first and second outlet ports 30, 34 and operate simultaneously, but will operate with a performance loss.

Figure 11:
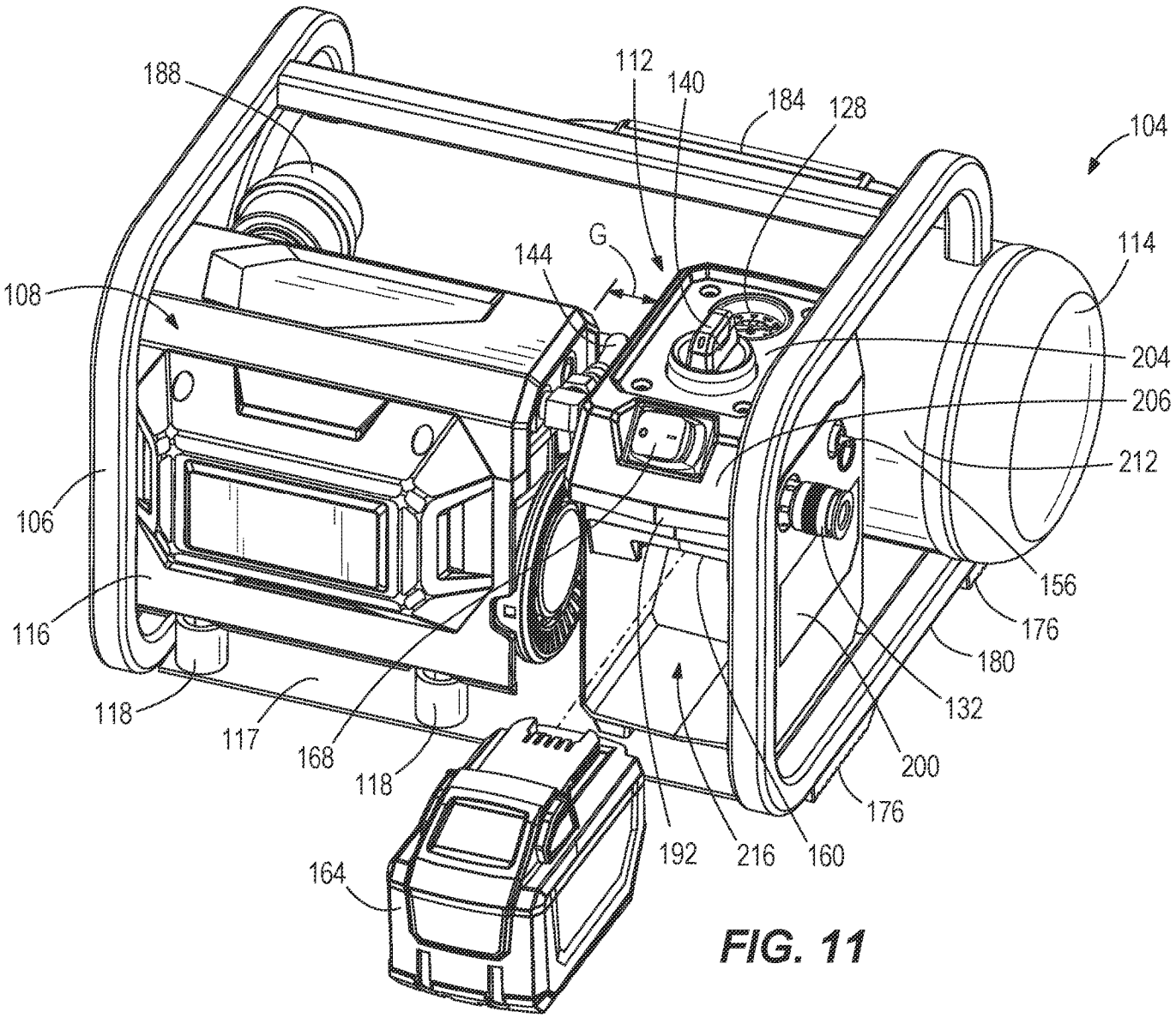
FIG. 11 is a perspective view of an air compressor in accordance with another embodiment of the invention.
Figure 12:
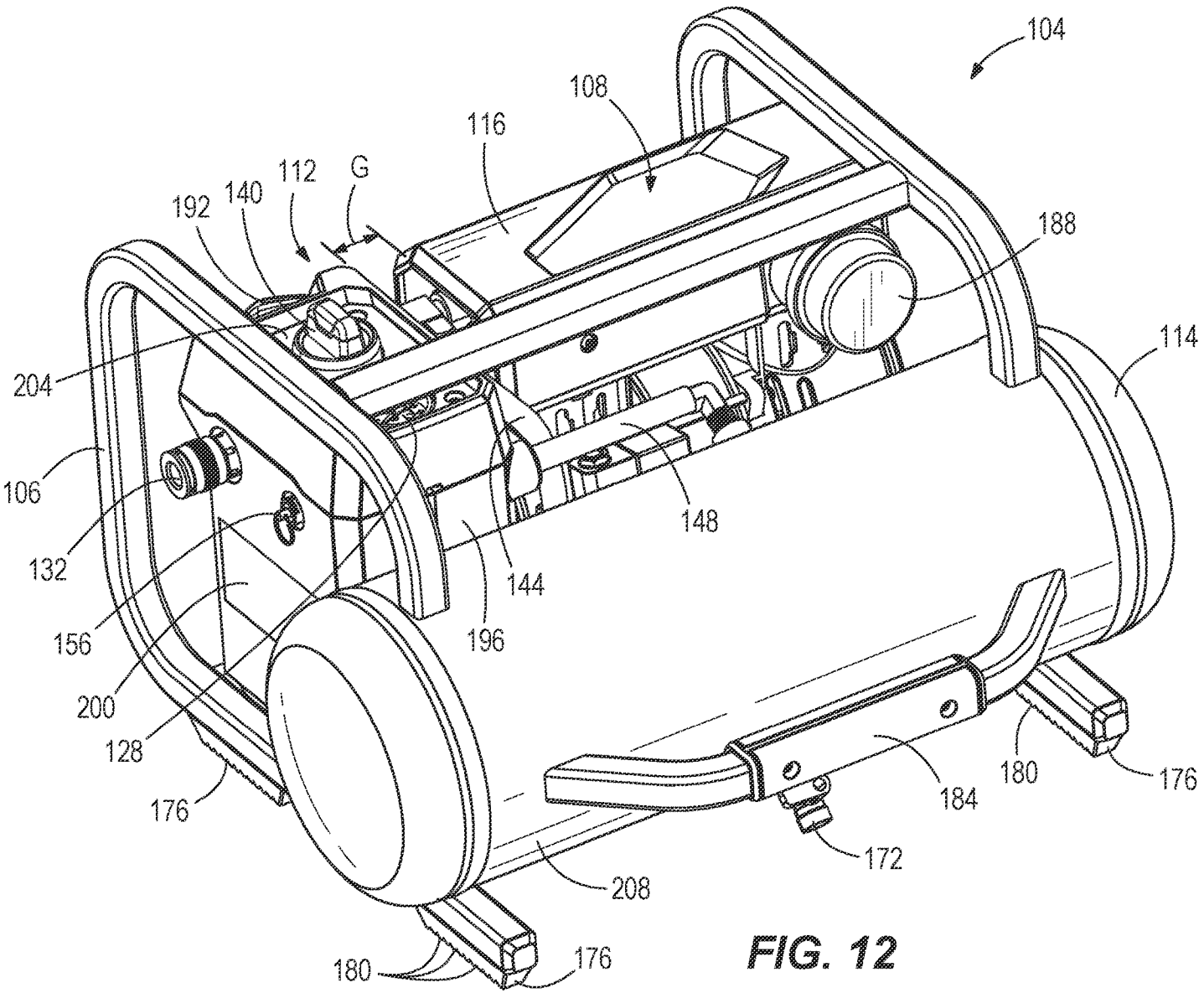
FIG. 12 is another perspective view of the air compressor of FIG. 11.
Figure 13:
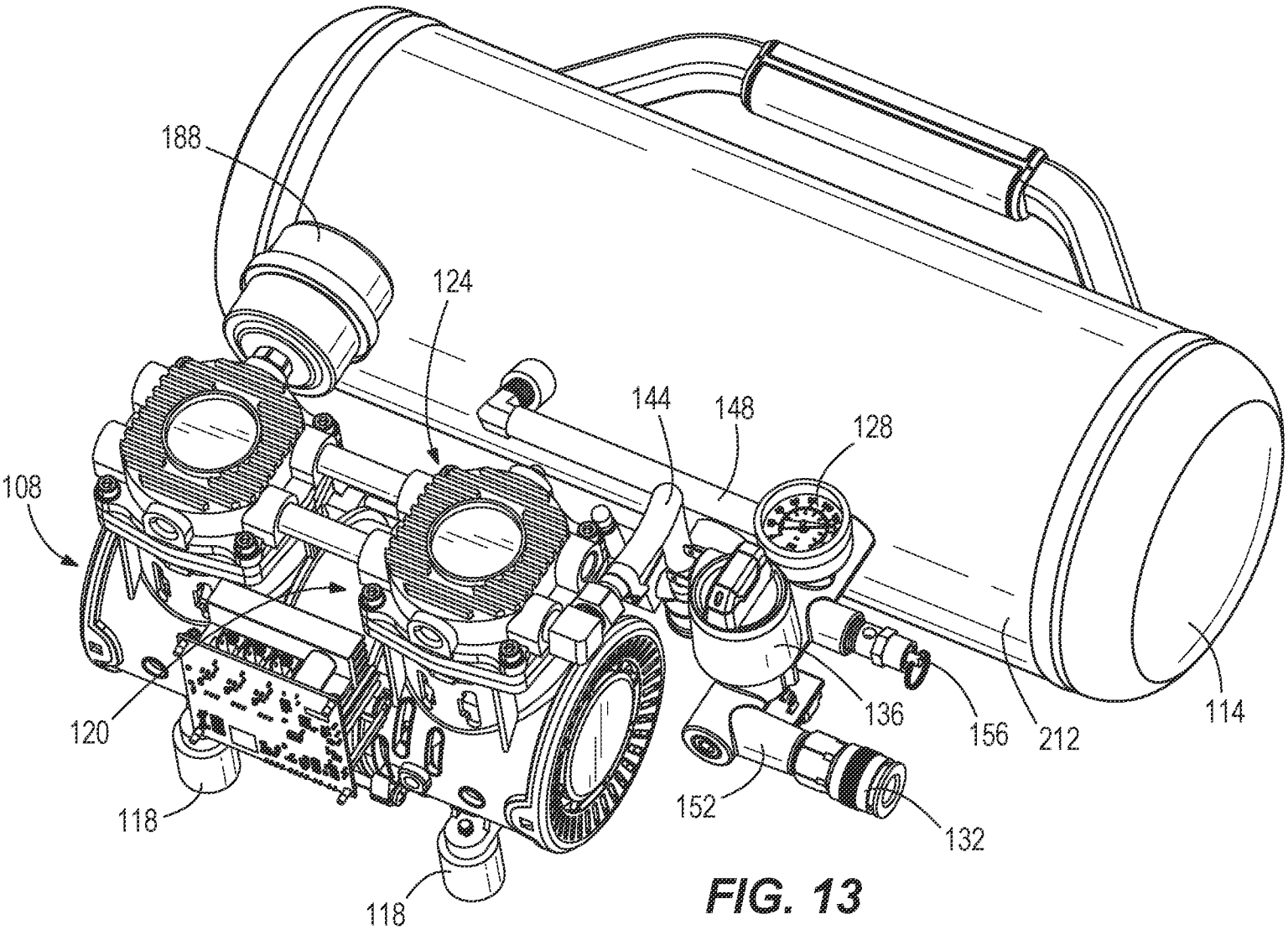
FIG. 13 is another perspective view of the air compressor of FIG. 11, with portions removed.

FIGS. 11-13 illustrate a portable air compressor 104 according to another embodiment of the invention. The compressor 104 includes a frame 106, a compressor unit 108 coupled to the frame 106, a battery compartment 112 coupled to the frame 106, and an air tank 114 for storing air compressed by the compressor unit 108. The air tank 114 has a volume of 2 gallons, making the compressor 104 portable and able to be hand-carried by users to and between job sites.

As shown in FIG. 11, the compressor unit 108 includes a cover 116 that is separate from the battery compartment 112 and that partially surrounds the compressor unit 108. As shown in FIG. 11, the compressor unit 108 is spaced from the battery compartment 112, such that there is a gap G therebetween, thereby further attenuating vibration transferred from the compressor unit 108 to the battery compartment 112 during operation of the compressor unit 108. As also shown in FIG. 11, the compressor unit 108 is coupled to a cross member 117 of the frame 106 via a plurality of elastomeric mounts 118, such that vibration transferred from the compressor unit 108 to the frame 106, and thus the battery compartment 112, during operation of the compressor unit 108 is inhibited. Though only two elastomeric mounts 118 are shown in FIG. 11, a total of four elastomeric mounts 114 couple the compressor unit 108 to the frame 106, and in some embodiments there are more or fewer elastomeric mounts 114 coupling the compressor unit 108 to the frame 106.

As shown in FIG. 13, the compressor unit 108 includes an electric motor 120 and a reciprocating, dual-cylinder pump 124 driven by the motor 120 to supply compressed air to the air tank 114. The electric motor 120 and pump 124 are at least partially surrounded by the cover 116. In some embodiments, the motor 120 is a brushless DC electric motor operable from an 18 Volt power source. The compressor 104 also includes a tank gauge 128 for indicating a pressure of air stored within the air tank 114 (FIG. 11). The compressor 104 further includes an outlet port 132 for supplying compressed air from the air tank 22. In the illustrated embodiment, the outlet port 132 is configured as a quick-release female fitting to which hoses having corresponding male fittings may be attached.

As shown in FIG. 13, the compressor 104 includes a pressure regulator 136 between the air tank 114 and the outlet port 132 for regulating the pressure of air supplied from the outlet port 132. The compressor 104 also includes an actuator 140 (e.g., a dial, shown in FIGS. 11 and 12) for adjusting the pressure regulator 136 and thus, the regulated pressure of air supplied from the outlet port 132. The compressor 104 further includes a flexible compressed air line 144 (FIG. 13) fluidly coupling the compressor unit 108 to the air tank 114, a supply line 148 fluidly coupling the air tank 114 to the regulator 136, and an outlet conduit 152 downstream of the regulator 136 to supply compressed air at a regulated pressure to the outlet port 132. As shown in FIG. 11, the air line 144 is arranged within the gap G between the compressor unit 108 and the battery compartment 112. Because the air line 144 is flexible, it does not transmit vibration from the compressor unit 108 to the battery compartment 112, and thus, with the elastomeric mounts 118, help isolate the compressor unit 108 during operation so to reduce the amount of vibration transmitted to the other components of the compressor 104. The compressor 104 further includes a pressure relief valve 156. Prior to putting the compressor 104 in storage for a period of time, the operator can actuate the pressure relief valve 156 to discharge compressed air stored in the air tank 114, the supply line 148, and the outlet conduit 152.

As shown in FIG. 11, the battery compartment 112 includes a battery receptacle 160 for receiving a battery pack 164. In some embodiments, the battery receptacle 160 is the same as battery receptacle 62. The battery receptacle 160 includes a pair of terminals (not shown) that mate with a corresponding pair of terminals (not shown) on the battery pack 164, such that the battery pack 164 can provide power to the compressor unit 108 when it is received in the battery receptacle 160. In some embodiments, the battery pack 164 is a rechargeable power tool battery pack, such as an 18V lithium-ion battery pack. The compressor 104 also includes a switch 168 for turning the compressor unit 108 on and off. The air tank 114 includes a drain valve 172 (FIG. 12) for draining condensation accumulated in the air tank 114 when the air tank 114 is depressurized with the relief valve 156.

The frame 106 includes a plurality of elastomeric members 176 on a bottom side 180 thereof. The elastomeric members 176 are configured to support the compressor 104 upon a surface. Each of the elastomeric members 176 include a plurality of ribs or ridges 180 to inhibit the compressor 104 from slipping on the surface during operation of the compressor unit 108. The compressor 104 also includes a handle 184 extending from the air tank 114 to allow an operator to pick up and carry the compressor 104 between locations on a job site. The compressor 104 also includes a filter 188 through which air is drawn into the compressor unit 108.

As shown in FIGS. 11 and 12, the battery compartment 112 has a first (front) wall 192, a second (rear) wall 196 opposite the first wall 192 and in facing relationship with the air tank 114, a third (side) wall 200 between the first and second walls 192, 196, a fourth (top) wall 204 adjacent the front, rear, and side walls 192, 196, 200, and a fifth wall 206 between the front and top walls 192, 204. The handle 184 extends from a side 208 of the air tank 114 that is opposite a side 212 that is in facing relationship with the rear wall 196 of the battery compartment 112.

As shown in FIGS. 11 and 12, the tank gauge 128 and the actuator 140 are both located on the top wall 204, and the switch 168 is arranged on the fifth wall 206, such that the tank gauge 128, the actuator 140, and the switch 168 are all visible and accessible from above the compressor 104. Thus, it is easy for an operator that is standing to quickly glance down at the top of the compressor 104 to evaluate and/or interact with the switch 168, the tank gauge 128 or the actuator 140.

The battery compartment 112 at least partially defines an opening 216 on the front wall 192 of the battery compartment 112 within which the battery pack 164 is received and within which the battery receptacle 160 is located. As such, the battery pack 164 is attachable to and removable from the battery receptacle 160 from the front wall 192 of the battery compartment 112. The outlet port 132 and the pressure relief valve 156 protrude from the third wall 200 of the battery compartment 112. Because the tank gauge 128, the actuator 140, the switch 168, the outlet port 132, the relief valve 156, and the battery receptacle 160 are all arranged on or at least partially within the battery compartment 112, it is convenient for an operator to quickly evaluate and/or interact with any of these elements, which facilitates operation of the compressor 104.

Various features of the invention are set forth in the following claims.

What is claimed is:

1. A portable air compressor comprising:

a frame;

a compressor unit;

a plurality of elastomeric mounts coupling the compressor unit to the frame, such that during operation of the compressor unit, vibration from the compressor unit to the frame is inhibited;

an air tank for storing compressed air generated by the compressor unit, the air tank coupled to the frame;

a battery compartment coupled to the frame, the battery compartment defining an opening and a battery receptacle within the opening;

a battery pack selectively electrically connectable to the battery receptacle to provide power to the compressor unit;

an outlet port for supplying compressed air from the air tank;

a tank gauge for indicating a pressure of the air stored within the air tank;

a pressure regulator between the air tank and the outlet port for regulating the pressure of air supplied from the outlet port;

an actuator for adjusting the regulated pressure of air supplied from the outlet port;

a compressed air line fluidly coupling the compressor unit to the air tank, the compressed air line arranged between the compressor unit and the battery compartment; and a switch for turning the compressor unit on and off.

2. The portable, battery-powered air compressor of claim 1, wherein the battery compartment is rigidly fastened to the frame.

* * * * *